US009235181B2

(12) United States Patent
Egi et al.

(10) Patent No.: US 9,235,181 B2
(45) Date of Patent: Jan. 12, 2016

(54) FIXING DEVICE INCLUDING FIXING BELT, DETECTED MEMBER CO-ROTATED WITH FIXING BELT AND ROTATION DETECTING PART DETECTING ROTATION OF DETECTED MEMBER AND IMAGE FORMING APPARATUS INCLUDING THE SAME

(71) Applicant: KYOCERA Document Solutions Inc., Osaka (JP)

(72) Inventors: Makoto Egi, Osaka (JP); Ryohei Tokunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/309,040

(22) Filed: Jun. 19, 2014

(65) Prior Publication Data

US 2014/0376934 A1 Dec. 25, 2014

(30) Foreign Application Priority Data

Jun. 20, 2013 (JP) ..... 2013-129457

(51) Int. Cl.
*G03G 15/00* (2006.01)
*G03G 15/20* (2006.01)

(52) U.S. Cl.
CPC ..... *G03G 15/55* (2013.01); *G03G 15/205* (2013.01); *G03G 2215/2035* (2013.01)

(58) Field of Classification Search
CPC ..... G03G 15/205; G03G 15/2089; G03G 15/2053; G03G 15/55; G03G 2215/2035
USPC ..... 399/33, 69, 329
See application file for complete search history.

(56) References Cited

U.S. PATENT DOCUMENTS

| | | | | |
|---|---|---|---|---|
| 7,596,327 | B2 * | 9/2009 | Kamimura | G03G 15/55 399/12 |
| 8,131,197 | B2 * | 3/2012 | Hiraoka et al. | 399/329 |
| 2009/0245842 | A1 * | 10/2009 | Segawa | 399/69 |
| 2011/0229161 | A1 * | 9/2011 | Ueno et al. | 399/33 |
| 2012/0263509 | A1 * | 10/2012 | Yokoyama | 399/329 |

FOREIGN PATENT DOCUMENTS

| | | | |
|---|---|---|---|
| JP | 63298362 | A * | 12/1988 |
| JP | 2010-072480 | A | 4/2010 |

* cited by examiner

*Primary Examiner* — Clayton E Laballe
*Assistant Examiner* — Trevor J Bervik
(74) *Attorney, Agent, or Firm* — Studebaker & Brackett PC

(57) ABSTRACT

A fixing device includes a fixing belt, a pressuring rotation body, a drive source, a heat source, detected members, rotation detecting parts, a storing part and a controlling part. The storing part stores standard condition for occurrence difficulty of a slip between the fixing belt and detected members co-rotated with rotation of the fixing belt. The controlling part stops heating of the fixing belt by the heat source on a condition that both rotation detecting parts do not detect the rotation of the detected members within a first time when the drive source rotates the fixing belt in a situation unsatisfying the standard condition. The controlling part stops the heating on a condition that at least one of the rotation detecting parts does not detect the rotation of the detected members within a second time when the drive source rotates the fixing belt in a situation satisfying the standard condition.

18 Claims, 6 Drawing Sheets

FIXING DEVICE INCLUDING FIXING BELT, DETECTED MEMBER CO-ROTATED WITH FIXING BELT AND ROTATION DETECTING PART DETECTING ROTATION OF DETECTED MEMBER AND IMAGE FORMING APPARATUS INCLUDING THE SAME

INCORPORATION BY REFERENCE

This application is based on and claims the benefit of priority from Japanese Patent application No. 2013-129457 filed on Jun. 20, 2013, the entire contents of which are incorporated herein by reference.

BACKGROUND

The present disclosure relates to a fixing device fixing a toner image on a recording medium and an image forming apparatus including the fixing device.

An electrographic image forming apparatus, such as a printer or a copying machine, forms a toner image on a surface of a recording medium, such as a sheet, and then, heats and pressures the recording medium and toner image by a fixing device, thereby fixing the toner image on the recording medium.

As a manner applied in the above-mentioned fixing device, a manner forming a fixing nip heating and pressuring the recording medium and toner image by a fixing roller and a pressuring roller is known. The above-mentioned fixing roller is formed, for example, by covering the outer circumference face of a cored bar made of metal by a resin having high toner releasability. As a heat source heating the above-mentioned fixing roller, for example, a halogen heater is used. The halogen heater is arranged, for example, inside the cored bar of the fixing roller.

On the other hand, another manner (so-called as an "IH (Induction Heating) manner") using an IH coil as the heat source instead of the halogen heater is known. The above-mentioned IH coil produces magnetic field by conducting electricity. In such an IH manner-type fixing device, instead of forming the fixing nip by the fixing roller and pressuring roller, the fixing nip is often formed by a fixing belt and the pressuring roller. The above-mentioned fixing belt is made of a rotatable endless belt. The magnetic field produced by the above-mentioned IH coil acts on the fixing belt so as to produce eddy current, thereby generating heat in the fixing belt.

As a rotating manner of the fixing belt, a manner rotating the fixing belt together with one or more rollers arranged at an internal diameter side of the fixing belt is known. On the other hand, another manner sliding the fixing belt with respect to a pressuring member arranged at the internal diameter side of the fixing belt is also known.

In the fixing device with such a manner, since temperature rising rate of the fixing belt is high, if the fixing belt is heated in a stopping state, there is a possibility that the temperature of a part of the fixing belt is excessively risen and the excessive risen part receives damage. Then, for example, there is the fixing device including the fixing belt and a rotation detecting part detecting a rotation state of the fixing belt. In this fixing device, in a case where the rotation detecting part does not detect the rotation of the fixing belt for a predetermined time continuously, heating of the fixing belt is suppressed.

In such a fixing device, as a configuration detecting the rotation of the fixing belt, for example, a configuration to attach a detected member co-rotating with the rotation of the fixing belt to an end part of the fixing belt and to detect rotation of the above-mentioned detected member by a rotation detecting part is considered. In a case of applying such a configuration, when the detected member is glued and fixed to the end part of the fixing belt, the detected member may be securely co-rotated with the rotation of the fixing belt. However, if the detected member is glued and fixed to the end part of the fixing belt as mentioned above, the end part of the fixing belt is corrected in a roughly precise round shape by the detected member. Therefore, a shape (an imprecise round shape) of a periphery part of the fixing nip of the fixing belt and the shape (the roughly precise round shape) of the end part of the fixing belt are different from each other, and accordingly, there is a possibility that great stress is added to the fixing belt to break down the fixing belt.

By contrast, when the detected member is not glued to the end part of the fixing belt, the end part of the fixing belt may be deformed in the imprecise round shape in accordance with the shape (the imprecise round shape) of the periphery part of the fixing nip of the fixing belt. Therefore, the stress added to the fixing belt may be reduced and the break of the fixing belt is prevented.

However, if the detected member is not glued to the end part of the fixing belt, there is a possibility that a slip is occurred between the fixing belt and detected member. When the slip is thus occurred, it is impossible to co-rotate the detected member with the rotation of the fixing belt. As a result, there is a possibility that the rotation detecting part cannot detect the rotation of the detected part regardless of the normal rotation of the fixing belt, and then, misdetection indicating abnormality of a rotation state of the fixing belt is caused and the heating of the fixing belt is stopped.

Moreover, in the fixing device using the fixing belt, after the end part of the fixing belt is broken for some reason, a matter of continuously rotating the fixing belt may be caused. With regard to such a point, in the fixing device, the break of the end part of the fixing belt is often detected by a temperature sensor. However, in such a configuration, there is a possibility that the break of the end part of the fixing belt cannot be detected depending on position relationship between an occurrence location of the break and the temperature sensor.

SUMMARY

In accordance with an embodiment of the present disclosure, a fixing device includes a fixing belt, a pressuring rotation body, a drive source, a heat source, detected members, a pair of rotation detecting parts, a storing part and a controlling part. The fixing belt rotates around a rotation axis. The pressuring rotation body comes into pressure contact with the fixing belt to form a fixing nip. The drive source rotates the fixing belt. The heat source heats the fixing belt. The detected members are held respectively by both end parts of the fixing belt and co-rotated with rotation of the fixing belt. The rotation detecting parts detect rotation of the detected members. The storing part stores standard condition set as a standard for deciding occurrence difficulty of a slip between both end parts of the fixing belt and the detected members. The controlling part stops heating of the fixing belt by the heat source on a condition that both rotation detecting parts do not detect the rotation of the detected members within a first time when the drive source rotates the fixing belt in a situation where the standard condition is not satisfied. The controlling part stops the heating of the fixing belt by the heat source on a condition that at least one of the rotation detecting parts does not detect the rotation of the detected members within a second time when the drive source rotates the fixing belt in a situation where the standard condition is satisfied.

In accordance with an embodiment of the present disclosure, an image forming apparatus includes a fixing device. The fixing device includes a fixing belt, a pressuring rotation body, a drive source, a heat source, detected members, a pair of rotation detecting parts, a storing part and a controlling part. The fixing belt rotates around a rotation axis. The pressuring rotation body comes into pressure contact with the fixing belt to form a fixing nip. The drive source rotates the fixing belt. The heat source heats the fixing belt. The detected members are held respectively by both end parts of the fixing belt and co-rotated with rotation of the fixing belt. The rotation detecting parts detect rotation of the detected members. The storing part stores standard condition set as a standard for deciding occurrence difficulty of a slip between both end parts of the fixing belt and the detected members. The controlling part stops heating of the fixing belt by the heat source on a condition that both rotation detecting parts do not detect the rotation of the detected members within a first time when the drive source rotates the fixing belt in a situation where the standard condition is not satisfied. The controlling part stops the heating of the fixing belt by the heat source on a condition that at least one of the rotation detecting parts does not detect the rotation of the detected members within a second time when the drive source rotates the fixing belt in a situation where the standard condition is satisfied.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
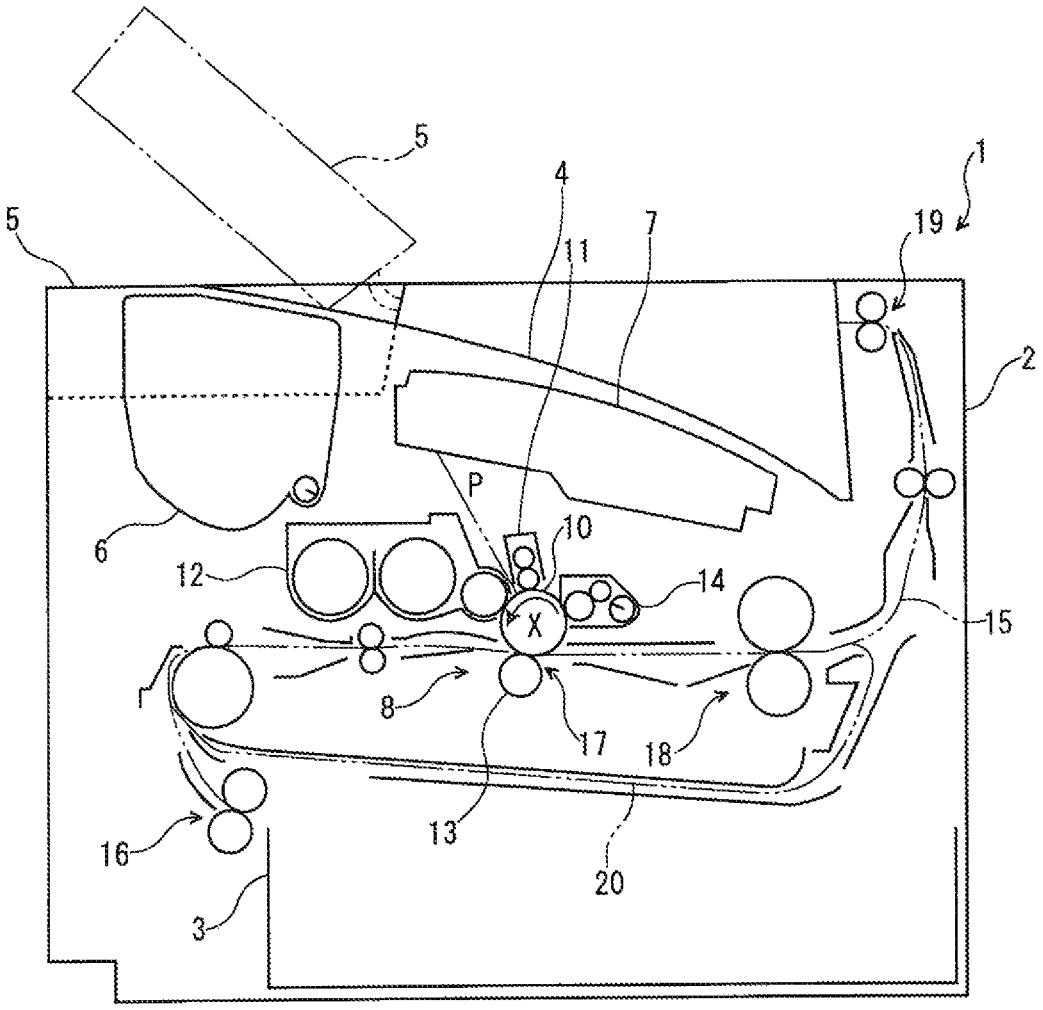
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, a sheet ejected tray 4 is formed. To top face of the printer main body 2, an upper cover 5 is openably/closably attached at the side of the sheet ejected tray 4 and, below the upper cover 5, a toner container 6 is installed.

In an upper part of the printer main body 2, an exposure device 7 composed of a laser scanning unit (LSU) is located below the sheet ejected tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electric-charged by the charger 11. Then, exposure corresponding to the image data on the photosensitive drum 10 is carried out by a laser light (refer to a two-dot chain line P in FIG. 1) from the exposure device 7, thereby forming an electrostatic latent image on the surface of the photosensitive drum 10. Subsequently, the development device 12 develops the electrostatic latent image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image carried on the photosensitive drum 10 is transferred onto the sheet in the transferring part 17. The sheet with the transferred toner image is conveyed to a downstream side in the conveying path 15 to go forward to the fixing device 18, and then, the toner image is fixed on the sheet in the fixing device 18. The sheet with the fixed toner image is ejected from the sheet ejecting part 19 to the sheet ejected tray 4. The toner remained on the photosensitive drum 10 is collected by the cleaning device 14.

Next, the fixing device 18 will be described in detail with reference to FIGS. 2-5.

Hereinafter, it will be described so that the front side of the fixing device 18 is positioned at the near side of FIG. 2, for convenience of explanation. Arrows Fr in FIGS. 3 and 4 indicate the front side of fixing device 18. An arrow I in FIG. 4 indicates inside in forward and backward directions and an arrow O in FIG. 4 indicates outside in the forward and backward directions.

Figure 2:
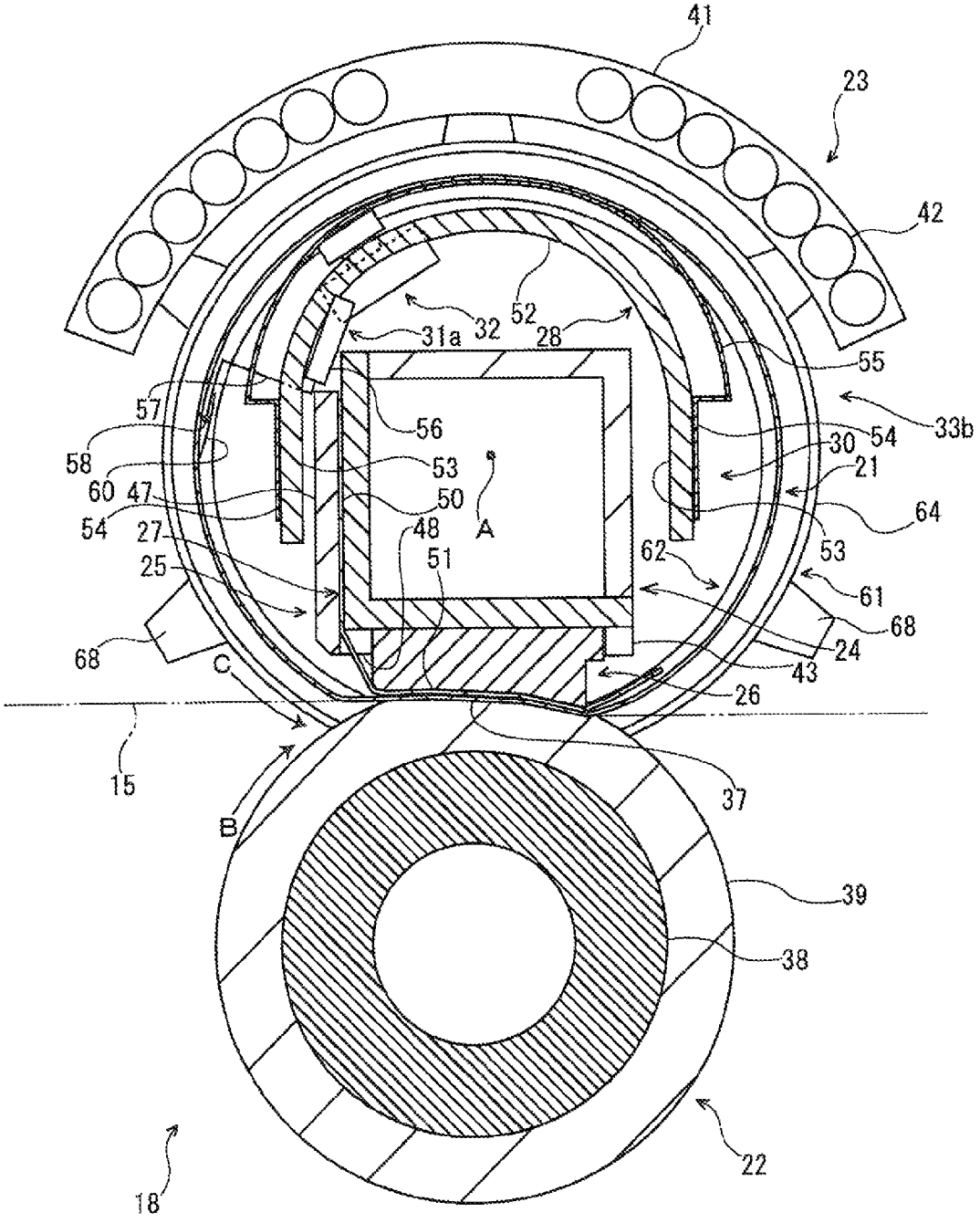
FIG. 2 is a sectional view showing a fixing device of the printer according to the embodiment of the present disclosure.
Figure 3:
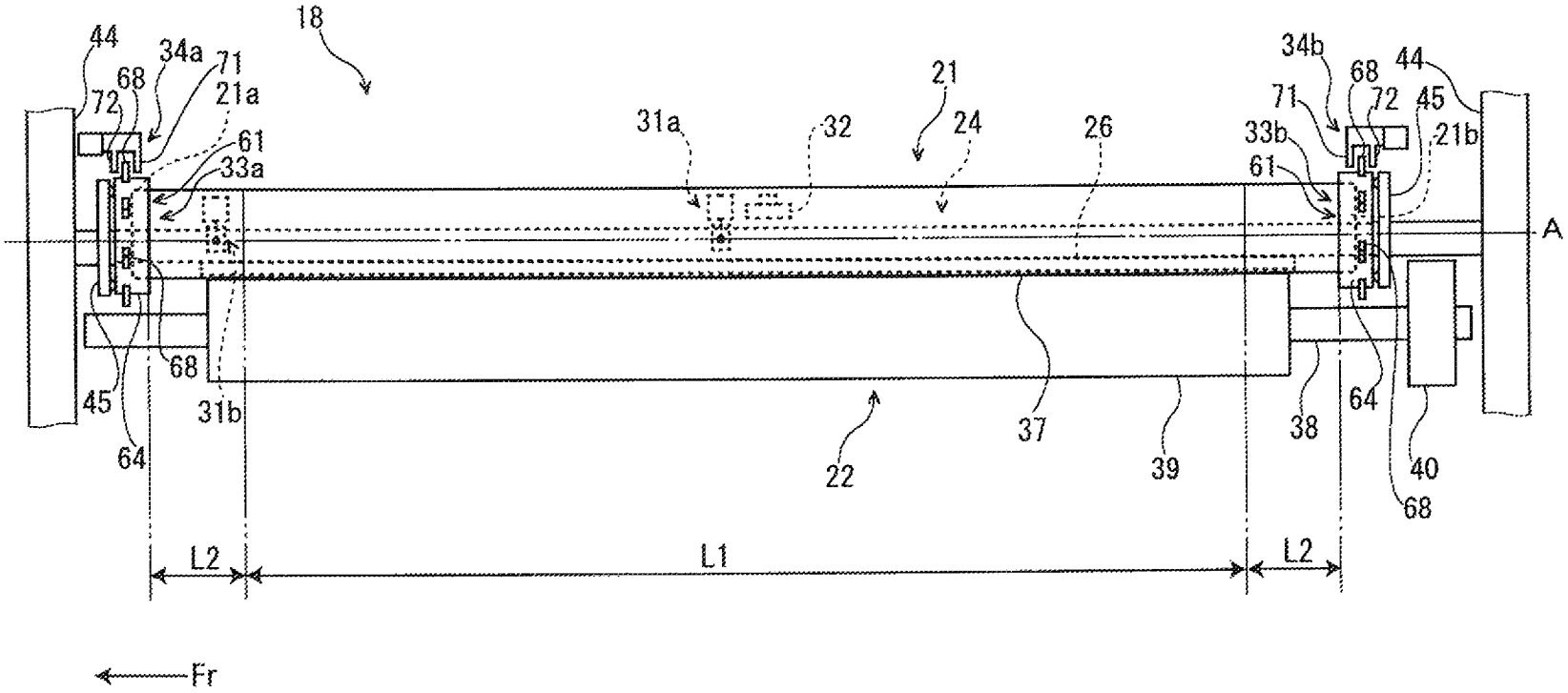
FIG. 3 is a side view showing the fixing device of the printer according to the embodiment of the present disclosure.

As shown in FIGS. 2 and 3, the fixing device 18 includes a fixing belt 21, a pressuring roller 22 (a pressuring rotation body), an 111 (Induction Heating) fixing unit 23 (not shown in FIG. 3), a supporting member 24, a reinforcement member 25, a pressing pad 26 (a pressing member), a slide contacting member 27, a magnetism shielding member 28, a guide member 30, a pair of thermistors 31*a* and 31*b* (temperature detecting parts), a thermal insulating part 32 (a so-called thermo-cut), detected members 33*a* and 33*b*, and a pair of rotation detecting parts 34*a* and 34*b*. The pressuring roller 22 is positioned below the fixing belt 21. The IH fixing unit 23 is positioned above the fixing belt 21. The supporting member 24 is positioned at an internal diameter side of the fixing belt 21. The reinforcement member 25 is positioned at the internal diameter side of the fixing belt 21 and at the left side of the supporting member 24. The pressing pad 26 is positioned at the internal diameter side of the fixing belt 21 and at the downward side of the supporting member 24. The slide contacting member 27 is positioned at the internal diameter side of the fixing belt 21 and from the left side to the downward side in the supporting member 24 and pressing pad 26. The magnetism shielding member 28 is positioned at the internal diameter side of the fixing belt 21 and at the upward side of the supporting member 24. The guide member 30 is positioned at the internal diameter side of the fixing belt 21 and at the upward side of the magnetism shielding member 28. The thermistors 31*a* and 31*b* are positioned at the internal diameter side of the fixing belt 21 and at the left side of the supporting member 24. The thermal insulating part 32 is positioned at the internal diameter side of the fixing belt 21 and at the left upward side of the supporting member 24. The detected members 33*a* and 33*b* are respectively held by both end parts 21*a* and 21*b* (a front end part 21*a* and a rear end part 21*b*) of the fixing belt 21. The rotation detecting parts 34*a* and 34*b* are respectively positioned above the detected members 33*a* and 33*b*.

The fixing belt 21 is an endless thin belt having flexibility and is formed in a cylindrical shape elongated in the forward and backward directions. The fixing belt 21 is arranged to rotate around a rotation axis A extended in the forward and backward directions. That is, in the embodiment, a rotation axis direction of the fixing belt 21 is equal to the forward and backward directions.

The fixing belt 21 is composed of, for example, a base material layer and a release layer covering the base material layer. The base material layer of the fixing belt 21 is made of, for example, metal, such as nickel or stainless, or resin, such as polyimide (PI). The release layer of the fixing belt 21 is made of, for example, fluorine-based resin, such as perfluoro alkoxy alkane (PFA). The fixing belt 21 may have an elastic layer between the base material layer and release layer. The elastic layer is made of, for example, a silicone rubber.

The pressuring roller 22 is formed in a cylindrical shape elongated in the forward and backward directions. As shown in FIG. 2, the pressuring roller 22 comes into pressure contact with the fixing belt 21 and a fixing nip 37 is formed between the fixing belt 21 and pressuring roller 22. When the sheet is passed through the fixing nip 37, the sheet and toner image is heated and pressured, and then, the toner image is fixed to the sheet.

The pressuring roller 22 is rotatably supported by a fixing frame (not shown). The pressuring roller 22 is composed of, for example, a cylindrical cored bar 38, an elastic layer 39 provided around the cored bar 38 and a release layer (not shown) covering the elastic layer 39. The cored bar 38 of the pressuring roller 22 is made of, for example, metal, such as stainless or aluminum. To a rear end part of the cored bar 38 of the pressuring roller 22, a drive gear 40 (refer to FIG. 3) is fixed. The elastic layer 39 of the pressuring roller 22 is made of, for example, a silicone rubber or a silicone sponge. The release layer of the pressuring roller 22 is made of, for example, fluorine-based resin, such as PFA. The pressuring roller 22 is omitted in FIG. 4.

As shown in FIG. 2, the IH fixing unit 23 includes a case member 41 and an IH coil 42 (a heat source) installed in the case member 41. The IH coil 42 is positioned at the external diameter side of the fixing belt 21 and arranged in an arc-like form along the outer circumference of the fixing belt 21.

The supporting member 24 is extended in the forward and backward directions to penetrate the fixing belt 21. The supporting member 24 is made, for example, by combining a pair of L-shaped metal plates and has a rectangular sectional shape. In a right lower corner part of the supporting member 24, a supporting protrusion 43 is provided to protrude to the downward side.

Figure 4:
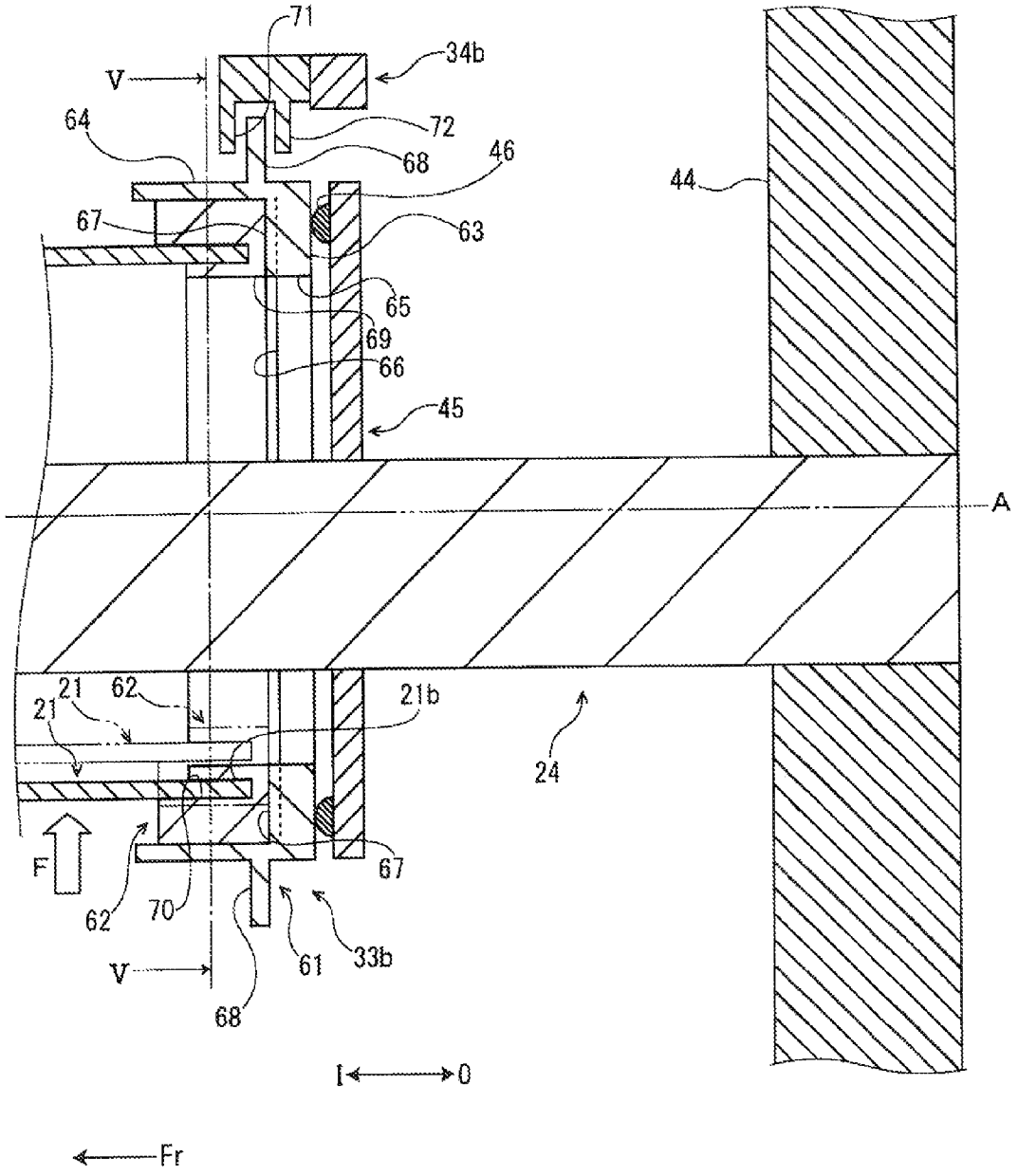
FIG. 4 is a side sectional view showing a rear end part of a fixing belt and the periphery in the fixing device of the printer according to the embodiment of the present disclosure.

As shown in FIG. 3, both end parts in the forward and backward directions of the supporting member 24 are fixed to fixing members 44 respectively arranged at the front side and rear side of the fixing belt 21. The fixing members 44 are, for example, fixed to a fixing frame (not shown) or constitute a part of the fixing frame. To both end parts in the forward and backward directions of the supporting member 24, ring-like formed bias stopping members 45 are fixed. The bias stopping members 45 are positioned at the internal side in the forward and backward directions from the respective fixing members 44. As shown in FIG. 4 and other figures, in faces at the internal side in the forward and backward directions of the bias stopping members 45, annular protruding parts 46 are respectively arranged.

As shown in FIG. 2, the reinforcement member 25 has a roughly L-shaped section and includes a first reinforcement part 47 extending in upward and downward directions and a second reinforcement part 48 bent from the lower end of the first reinforcement part 47 to the right side.

The pressing pad 26 is extended in the forward and backward directions. A top face of the pressing pad 26 is fixed to a bottom face of the supporting member 24. Thereby, the pressing pad 26 is supported by the supporting member 24. A bottom face of the pressing pad 26 presses the fixing belt 21 from the internal diameter side to the downward side (to the side of the pressuring roller 22). The pressing pad 26 is inserted between the supporting protrusion 43 of the supporting member 24 and the second reinforcement part 48 of the reinforcement member 25.

The slide contacting member 27 has, for example, a sheet-like shape. The slide contacting member 27 includes a first contact part 50 extending in the upward and downward directions and a second contact part 51 bent from the lower end of the first contact part 50 to the right side. The first contact part 50 is inserted between a left side part of the supporting member 24 and the first reinforcement part 47 of the reinforcement member 25. The second contact part 51 is inserted between the bottom face of the pressing pad 26 and the fixing belt 21. When the fixing belt 21 is rotated, the fixing belt 21 slides with respect to the pressing pad 26 and second contact part 51.

The magnetism shielding member 28 includes a curved plate part 52 curved in an arc-like form to the upward side and flat plate parts 53 extending from the both end parts in left and right directions of the curved plate part 52 to the downward side. The magnetism shielding member 28 is made of, for example, nonmagnetic material with excellent electric conductivity, such as oxygen free copper. The magnetism shielding member 28 prevent a magnetic field produced by the IH coil 42 from passing through the supporting member 24.

The guide member 30 is arranged so as to cover the upper side of the magnetism shielding member 28. The guide member 30 is made of, for example, a magnetic body. The guide member 30 has a function generating heat by the action of the magnetic field produced by the IH coil 42 to heat the fixing belt 21. The guide member 30 includes attachment parts 54 attached to the flat plate parts 53 of the magnetism shielding member 28 and a connection part 55 curved in an arc-like form to the upward side and connecting the attachment parts 54. The connection part 55 guides (strains) the fixing belt 21 from the internal diameter side.

As shown in FIG. 3, the thermistors 31*a* and 31*b* are arranged at intervals in the forward and backward directions.

The thermistor 31*a* is arranged at the center of a sheet passing region L1 (a region where a maximum size of the sheet is passed) in the fixing belt 21 and the thermistor 31*b* is arranged at a non-sheet passing region L2 (a region where a maximum size of the sheet is not passed) in the fixing belt 21.

As shown in FIG. 2, each of the thermistors 31*a* and 31*b* (in FIG. 2, the thermistor 31*a* is shown) includes a housing 56 fixed to the curved plate part 52 of the magnetism shielding member 28, a plate spring 57 having an end part attached to the housing 56 and a terminal 58 fixed to another end part of the plate spring 57. The terminal 58 is pressured to an inner circumference face of the fixing belt 21 by given pressure of the plate spring 57. That is, in the thermistor 31*a* and 31*b* of the embodiment, a contact manner is applied. The terminal 58 is covered by a cover sheet 60.

The thermal insulating part 32 is fixed to the curved plate part 52 of the magnetism shielding member 28. The thermal insulating part 32 faces to the fixing belt 21 at an interval. As shown in FIG. 3, the thermal insulating part 32 is positioned at the center of the sheet passing region L1 of the fixing belt 21. The thermal insulating part 32 has a function stopping the production of the magnetic field from the IH coil 42 to prevent excessive temperature rise of the fixing belt 21 when the temperature of the sheet passing region L1 of the fixing belt 21 becomes a predetermined value or more.

As shown in FIG. 4, the detected members 33*a* and 33*b* (in FIG. 4, the detected member 33*b* is shown) respectively include cap members 61 attached to both end parts 21*a* and 21*b* (in FIG. 4, the rear end part 21*b* is shown) of the fixing belt 21 and elastic members 62 interposed between both end parts 21*a* and 21*b* of the fixing belt 21 and cap members 61.

Each cap member 61 is made of, for example, heat resistant resin, such as liquid crystal polymer or polyphenylene sulfide (PPS). The cap members 61 respectively include main body parts 63 covering the outside in the forward and backward directions of both end parts 21*a* and 21*b* of the fixing belt 21 and cylindrical flange parts 64 extending from end parts at the external diameter side of the main body parts 63 to the inside in the forward and backward directions and covering the external diameter side of both end parts 21*a* and 21*b* of the fixing belt 21.

The main body part 63 of each cap member 61 is arranged roughly perpendicular to the rotation axis A of the fixing belt 21. In the main body part 63, a circular communication hole 65 is arranged in the forward and backward directions, and then, the supporting member 24 penetrates the communication hole 65. With outside face in the forward and backward directions of the main body part 63, the protruding part 46 of the bias stopping member 45 comes into contact. Thereby, movement of the cap member 61 to the outside in the forward and backward directions is restricted. In a face 66 at the inside in the forward and backward directions of the main body part 63, a plurality of ribs 67 are projected. The plurality of the ribs 67 are arranged radially around the rotation axis A of the fixing belt 21.

Figure 5:
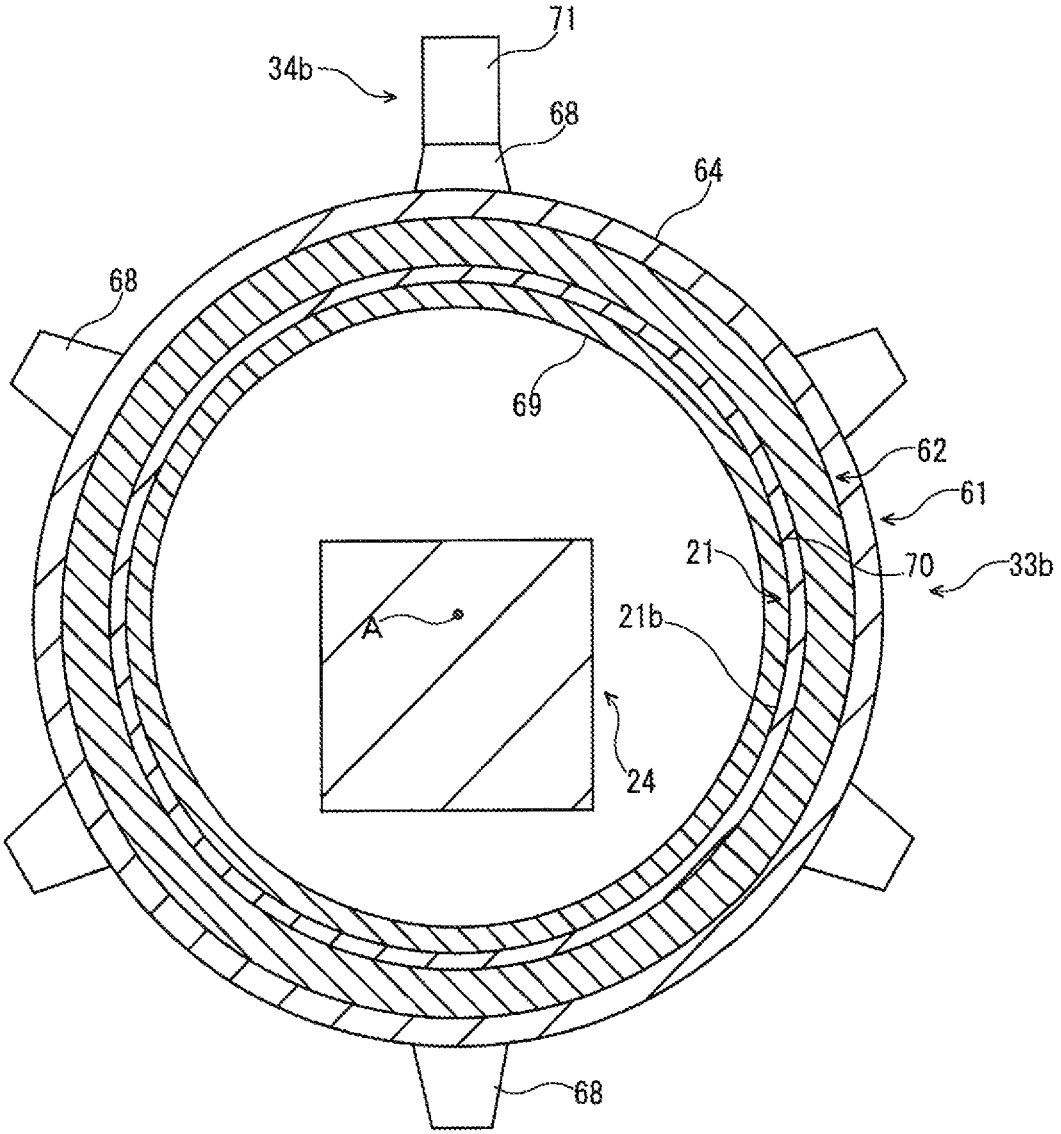
FIG. 5 is a sectional view taken along a line V-V of FIG. 4.

The flange part 64 of each cap member 61 is arranged in roughly parallel to the rotation axis A of the fixing belt 21. The flange part 64 is arranged at an interval from an outer circumference face of the fixing belt 21. In an outer circumference part of the flange part 64, detected pieces 68 are protruded. The outer circumference part of the flange part 64 corresponds to the outer circumference part of the entire cap member 61. As shown in FIG. 5, a plurality of the detected pieces 68 (six detected pieces 68 in the embodiment) are arranged at equal angular intervals (at intervals of 60 degrees in the embodiment).

The elastic member 62 is unglued to the fixing belt 21 and cap member 61. The elastic member 62 is made of, for example, a heat resistant rubber, such as a silicone rubber. In the elastic member 62, a circular through hole 69 is formed in the forward and backward directions, and then, the supporting member 24 penetrates the through hole 69. In the elastic member 62, an annular belt insertion part 70 is formed. The belt insertion part 70 is formed in a concave shape and opened to the inside in the forward and backward directions. Into the belt insertion part 70, both end parts 21*a* and 21*b* of the fixing belt 21 are inserted.

The pair of the rotation detecting parts 34*a* and 34*b* are, for example, photo interrupter (PI) sensors. As shown in FIG. 3 and other figures, the pair of the rotation detecting parts 34*a* and 34*b* respectively include light emitting parts 71 emitting light to the detected pieces 68 arranged in the cap members 61 of the detected members 33*a* and 33*b* and light receiving parts 72 receiving the light from the light emitting parts 71. When the detected pieces 33*a* and 33*b* are rotated, respective optical paths from the light emitting parts 71 to the light receiving parts 72 are sequentially opened/closed by the detected pieces 68, and then, the received light amounts of the respective light receiving parts 72 are sequentially switched between the High level and Low level. According to this, the pair of the rotation detecting parts 34*a* and 34*b* can detect the rotation of the detected members 33*a* and 33*b*.

Next, a control system for the fixing device 18 will be described.

Figure 6:
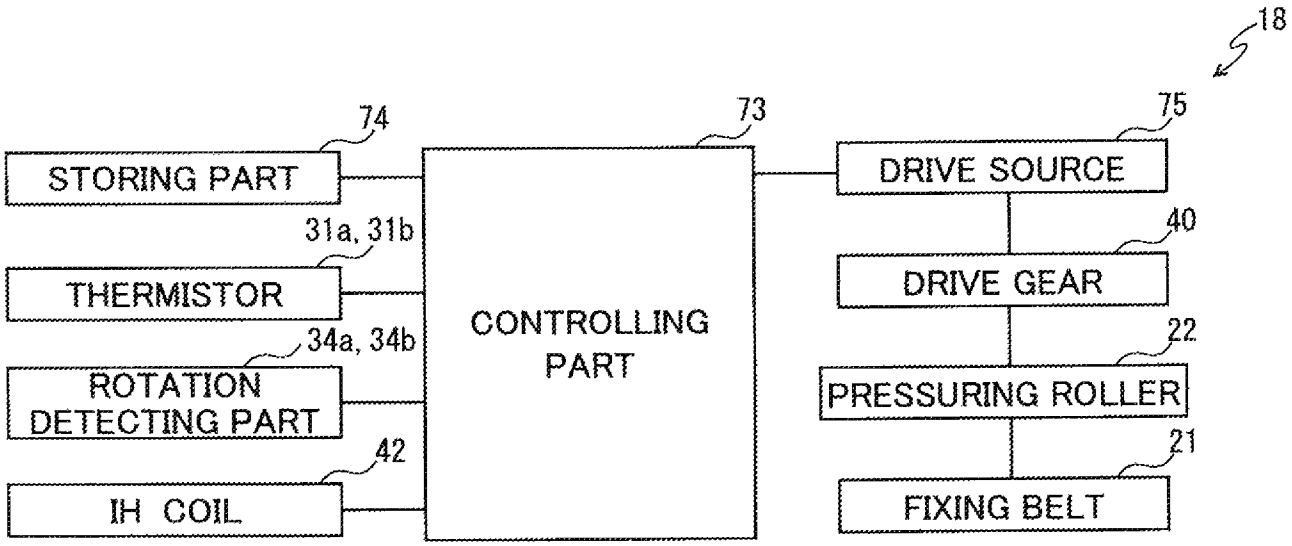
FIG. 6 is a block diagram showing a control system for the fixing device of the printer according to the embodiment of the present disclosure.

As shown in FIG. 6, in the fixing device 18, a controlling part 73 (CPU: Central Processing Unit) is installed. The controlling part 73 is connected to a storing part 74 composed of a storage device, such as a read only memory (ROM) or a random access memory (RAM). The fixing device 18 is configured so that the controlling part 73 controls components of the fixing device 18 on the basis of a control program or control data stored in the storing part 74.

The storing part 74 stores a first standard condition and a second standard condition set as standards for deciding occurrence difficulty of a slip between both end parts 21*a* and 21*b* of the fixing belt 21 and the detected members 33*a* and 33*b*. The first standard condition is a situation where the temperature of the fixing belt 21 has reached fixing temperature to fix the toner image on the sheet. The second standard condition is a situation where the sheet is not passed through the fixing nip 37.

The controlling part 73 is connected to the thermistors 31*a* and 31*b* so that the temperatures of the fixing belt 21 detected by the thermistors 31*a* and 31*b* are outputted to the controlling part 73.

The controlling part 73 is connected to the pair of the rotation detecting parts 34*a* and 34*b* so that, when the pair of the rotation detecting parts 34*a* and 34*b* detect the rotation of the detected members 33*a* and 33*b*, detection signals are outputted to the controlling part 73.

The controlling part 73 is connected to the IH coil 42. When a current is flowed to the IH coil 42 on the basis of drive command from the controlling part 73, the IH coil 42 produces the magnetic field, the action of the magnetic field produces eddy current to the fixing belt 21, and then, the heat is generated to the fixing belt 21. That is, by the IH coil 42, the fixing belt 21 can be heated.

The controlling part 73 is connected to a drive source 75 composed of a drive motor or the like and the drive source 75 is connected to the drive gear 40. When the drive source 75 rotates the drive gear 40, the pressuring roller 22 is rotated integrally with the drive gear 40 and the fixing belt 21 coming into pressure contact with the pressuring roller 22 is co-rotated with the rotation of the pressuring roller 22. That is, by the drive source 75, the fixing belt 21 can be rotated.

In a configuration as mentioned above, in order to fix the toner image on the sheet, the drive source 75 rotates the drive gear 40. According to this, the pressuring roller 22 is rotated integrally with the drive gear 40 (refer to an arrow B in FIG. 2) and the fixing belt 21 coming into pressure contact with the pressuring roller 22 is co-rotated with the rotation of the pressuring roller 22 (refer to an arrow C in FIG. 2). When the fixing belt 21 is thus rotated, by friction force between both end parts 21*a* and 21*b* of the fixing belt 21 and the detected members 33*a* and 33*b*, the detected members 33*a* and 33*b* are co-rotated with the rotation of the fixing belt 21. On the other hand, if the fixing belt 21 is rotated, the supporting member 24, pressing pad 26 and slide contacting member 27 are kept in stopping states.

Moreover, in order to fix the toner image on the sheet, the current is flowed to the IH coil 42. According to this, the IH coil 42 produces the magnetic field, the action of the magnetic field produces eddy current to the fixing belt 21, and then, the heat is generated to the fixing belt 21. In such a situation, when the sheet is passed through the fixing nip 37, the sheet and toner image is heated and pressured, and then, the toner image is fixed on the sheet.

Next, control of detecting the rotation of the detected members 33*a* and 33*b* will be described.

When temperature distribution or pressure balance in the forward and backward directions of the fixing nip 37 becomes ununiform, a phenomenon of biasing the fixing belt 21 to one side in the forward and backward directions in accordance with the rotation of the fixing belt 21 is occurred. At this time, with regard to the detected member 33*a* or 33*b* at a biasing side of the fixing belt 21, since the fixing belt 21 closely contacts with the detected member 33*a* or 33*b*, and then, co-rotating ability of the detected member 33*a* or 33*b* with respect to the fixing belt 21 is improved, the slip between the end part 21*a* or 21*b* of the fixing belt 21 and the detected member 33*a* or 33*b* is unlikely to occur. By contrast, with regard to the detected member 33*a* or 33*b* at an opposite side to the biasing side of the fixing belt 21, since an overlap amount of the detected member 33*a* or 33*b* with respect to the fixing belt 21 is reduced, and then, the co-rotating ability of the detected member 33*a* or 33*b* with respect to the fixing belt 21 is decreased, the slip between the end part 21*a* or 21*b* of the fixing belt 21 and the detected member 33*a* or 33*b* is likely to occur.

For example, in a situation in the middle of heating the fixing belt 21 to the fixing temperature by the IH coil 42 (hereinafter, called as a "starting-up situation"), the temperature distribution or the pressure balance in the forward and backward directions of the fixing nip 37 is likely to become ununiform. Therefore, the bias of the fixing belt 21 to one side in the forward and backward directions is likely to occur, and then, the slip between both end parts 21*a* and 21*b* of the fixing belt 21 and the detected members 33*a* and 33*b* is likely to occur.

For example, in a situation in the middle of passing (sequentially) the sheet through the fixing nip 37 (hereinafter, called as a "sheet passing situation"), when the sheet in a state biased to one side in the forward and backward directions is passed through the fixing nip 37, since heat taken by the sheet is also biased, the temperature distribution in the forward and backward directions of the fixing nip 37 is likely to become ununiform. Therefore, the bias of the fixing belt 21 to one side in the forward and backward directions is likely to occur and the slip between both end parts 21*a* and 21*b* of the fixing belt 21 and the detected members 33*a* and 33*b* is likely to occur.

In the embodiment, the first standard condition is not satisfied in the above-mentioned starting-up situation and the second standard condition is not satisfied in the above-mentioned sheet passing situation. When the drive source 75 rotates the fixing belt 21 in such a situation where the first standard condition or second standard condition is not satisfied, there is a high possibility that the slip between both end parts 21*a* and 21*b* of the fixing belt 21 and the detected members 33*a* and 33*b* occurs.

Then, by the controlling part 73, the heating of the fixing belt 21 by the IH coil 42 is stopped on a condition that both rotation detecting parts 34*a* and 34*b* do not detect the rotation of the detected members 33*a* and 33*b* within a predetermined first time. By applying such a configuration, even when one of the detected members 33*a* and 33*b* is not rotated, if another of the detected members 33*a* and 33*b* is rotated, the IH coil 42 can heat the fixing belt 21. Therefore, it is possible to prevent a situation of stopping the heating of the fixing belt 21 due to misdetection caused by the slip regardless of the normal rotation of the fixing belt 21.

Incidentally, if the above-mentioned "first time" is lengthened, in a case where the detected members 33*a* and 33*b* are stopped, it is possible to stop the heating of the fixing belt 21 by the IH coil 42. On other hand, if the above-mentioned "first time" is shortened, in a case where the detected members 33*a* and 33*b* are rotated at lower speed than the usual, it is possible to stop the heating of the fixing belt 21 by the IH coil 42.

Alternatively, for example, in a waiting situation with rotating the fixing belt 21 (hereinafter, called as an "aging situation before the fixing") after the temperature of the fixing belt 21 reaches the fixing temperature before the sheet passes through the fixing nip 37, both first standard condition and second standard condition are satisfied. When the drive source 75 rotates the fixing belt 21 in a situation where the first standard condition and second standard condition are satisfied, there is a low possibility that the slip between the fixing belt 21 and detected members 33*a* and 33*b* occurs. Conversely, if one of the detected members 33*a* and 33*b* is not rotated, there is a high possibility that the front end part 21*a* or the rear end part 21*b* of the fixing belt 21 is broken. Then, the controlling part 73 stops the heating of the fixing belt 21 by the IH coil 42 on a condition that at least one of the pair of the rotation detecting parts 34*a* and 34*b* does not detect the rotation of the detected members 33*a* and 33*b* within a predetermined second time. By applying such a configuration, in case where the fixing belt 21 is sequentially rotated after the front end part 21*a* or the rear end part 21*b* of the fixing belt 21 is broken, if the detected member 33*a* or 33*b* held by the end part at the broken side is stopped, it is possible to stop the heating of the fixing belt 21 by the IH coil 42. According to this, it is possible to securely detect the break of the front end part 21*a* or the rear end part 21*b* of the fixing belt 21. Incidentally, the above-mentioned second time may be equal to or different from the above-mentioned first time.

As described above, by classifying the heating stopping condition in accordance with whether or not each standard condition is satisfied, it is possible to prevent a situation of stopping the heating of the fixing belt 21 due to misdetection caused by the slip regardless of the normal rotation of the fixing belt 21 and to securely detect the break of the front end part 21*a* or the rear end part 21*b* of the fixing belt 21.

In the embodiment, the first standard condition is a situation that "the temperature of the fixing belt 21 has reached the fixing temperature". In the above-mentioned situation where the temperature of the fixing belt 21 has reached the fixing temperature, in comparison with the above-mentioned starting-up situation, the temperature distribution or pressure balance in the forward and backward directions of the fixing nip 37 is likely to become uniform. Accordingly, the bias of the fixing belt 21 to one side in the forward and backward directions is unlikely to occur and the slip between both end parts 21*a* and 21*b* of the fixing belt 21 and the detected members 33*a* and 33*b* is unlikely to occur. Therefore, the situation where the temperature of the fixing belt 21 has reached the fixing temperature is preferable as the standard condition.

In the embodiment, the second standard condition is a situation that "the sheet is not passed through the fixing nip 37". In the above-mentioned situation where the sheet is not passed through the fixing nip 37, in comparison with the above-mentioned sheet passing situation, the temperature distribution or pressure balance in the forward and backward directions of the fixing nip 37 is likely to become uniform. Accordingly, the bias of the fixing belt 21 to one side in the forward and backward directions is unlikely to occur and the slip between both end parts 21*a* and 21*b* of the fixing belt 21 and the detected members 33*a* and 33*b* is unlikely to occur. Therefore, the situation where the sheet is not passed through the fixing nip 37 is preferable as the standard condition.

In the embodiment, the aging situation before the fixing is set as a situation where the standard condition is satisfied. In the above-mentioned aging situation before the fixing, rotation stability of the fixing belt 21 is exceedingly high, and accordingly, the slip between both end parts 21*a* and 21*b* of the fixing belt 21 and the detected members 33*a* and 33*b* is exceedingly unlikely to occur. Therefore, the above-mentioned aging situation before the fixing is preferable as the situation where the standard condition is satisfied.

The detected members 33*a* and 33*b* are configured to be co-rotated with the rotation of the fixing belt 21 by the friction force between both end parts 21*a* and 21*b* of the fixing belt 21 and the detected members 33*a* and 33*b*. By applying such a configuration, it is unnecessary to glue the detected members 33*a* and 33*b* to both end parts 21*a* and 21*b* of the fixing belt 21, and accordingly, both end parts 21*a* and 21*b* of the fixing belt 21 are easy to deform in a shape corresponding to the shape of the periphery part of the fixing nip 37. Therefore, it is possible to reduce the stress added to the fixing belt 21 and to prevent the break of the fixing belt 21.

The detected members 33*a* and 33*b* include the elastic members 62 interposed between both end parts 21*a* and 21*b* of the fixing belt 21 and the cap members 61. Therefore, it is possible to prevent the both end parts 21*a* and 21*b* of the fixing belt 21 and the cap members 61 from being slidingly rubbed, and accordingly it is possible to prevent cracking of both end parts 21*a* and 21*b* of the fixing belt 21 and chipping of the cap members 61. Furthermore, it is possible to improve the co-rotating ability of the cap members 61 with respect to the fixing belt 21 by the elastic members 62. In addition, since the elastic members 62 are unglued to the fixing belt 21 and cap members 61, it is easy to deform the elastic members 62.

In the periphery part of the fixing nip 37, the fixing belt 21 is pressured upward by the pressure from the side of the pressuring roller 22 (refer to an arrow F in FIG. 4) and the fixing belt 21 is deformed to the internal diameter side (refer to a two-dot chain line in FIG. 4). At that time, in the embodiment, since the flange parts 64 of the cap members 61 are arranged to cover the external diameter side of both end parts 21*a* and 21*b* of the fixing belt 21, the deformation of the fixing belt 21 to the internal diameter side is not restricted by the presence of the flange parts 64 of the cap members 61, and then, it is possible to sufficiently secure a deformation amount of the fixing belt 21 to the internal diameter side. According to this, it is possible to respond to a case where great deformation of the fixing belt 21 to the internal diameter side is desired, i.e., a case where widening of width of the fixing nip 37 is desired.

The fixing device 18 is configured to apply a so-called "slide belt manner" and to include the pressing pad 26 pressing the fixing belt 21 to the downward side (to the side of the pressuring roller 22) and the supporting member 24 supporting the pressing pad 26. Therefore, it is possible to reduce heat capacity of the fixing device 18 and to swiftly rise temperature of the fixing belt 21.

In the embodiment, the situation where both first standard condition and second standard condition are satisfied is set as the situation where the standard condition is satisfied and the situation where at least one of the first standard condition and second standard condition is not satisfied is set as the situation where the standard condition is not satisfied. On the other hand, in another embodiment, a situation where at least one of the first standard condition and second standard condition is satisfied may be set as the situation where a standard condition is satisfied and a situation where both first standard condition and second standard condition are not satisfied may be set as a situation where the standard condition is not satisfied.

In the embodiment, two standard conditions are prepared. However, in another embodiment, one condition or three or more standard conditions may be prepared.

In the embodiment, a case where the detected pieces 68 are arranged in the cap members 61 of the detected members 33*a* and 33*b* was described. However, in another embodiment, the detected pieces 68 may be arranged in the elastic members 62 of the detected members 33*a* and 33*b*.

In the embodiment, a case of applying the configuration of the present disclosure to the fixing device 18 having the so-called "slide belt manner" was described. However, in another embodiment, the configuration of the present disclosure may be applied to the fixing device 18 having another manner rotating the fixing belt 21 together with one or more rollers arranged at the internal diameter side of the fixing belt 21.

In the embodiment, a case of inputting drive from the drive source 75 to the pressuring roller 22 was described. However, in another embodiment, the drive from the drive source 75 may be inputted to the fixing belt 21 or the drive from the drive source 75 may be inputted to both the pressuring roller 22 and fixing belt 21.

In the embodiment, a case of using the IH coil 42 as the heat source was described. However, in another embodiment, another heater, such as a halogen heater or a ceramic heater, may be used as the heat source.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt rotating around a rotation axis;

a pressuring rotation body coming into pressure contact with the fixing belt to form a fixing nip;

a drive source rotating the fixing belt;

a heat source heating the fixing belt;

detected members held respectively by both end parts of the fixing belt and co-rotated with rotation of the fixing belt;

a pair of rotation detecting parts detecting rotation of the detected members;

a storing part storing standard condition set as a standard for deciding occurrence difficulty of a slip between both end parts of the fixing belt and the detected members; and a controlling part configured to stop heating of the fixing belt by the heat source on a condition that both rotation detecting parts do not detect the rotation of the detected members within a first time when the drive source rotates the fixing belt in a situation where the standard condition is not satisfied, and to stop the heating of the fixing belt by the heat source on a condition that at least one of the rotation detecting parts does not detect the rotation of the detected members within a second time when the drive source rotates the fixing belt in a situation where the standard condition is satisfied, wherein the heat source heats the fixing belt, if one detected member is not rotated and another detected member is rotated, when the drive source rotates the fixing belt in the situation where the standard condition is not satisfied.

2. The fixing device according to claim 1, wherein the storing part stores, as the standard condition, a situation where the temperature of the fixing belt has reached fixing temperature to fix a toner image on a sheet.

3. The fixing device according to claim 1, wherein the storing part stores, as the standard condition, a situation where a sheet is not passed through the fixing nip.

4. The fixing device according to claim 1, wherein a situation after the temperature of the fixing belt reaches fixing temperature to fix a toner image on a sheet before the sheet passes through the fixing nip is set as the situation where the standard condition is satisfied.

5. The fixing device according to claim 1, wherein the detected members are configured to be co-rotated with the rotation of the fixing belt by friction force between both end parts of the fixing belt and the detected members.

6. The fixing device according to claim 1, wherein the detected member includes:

a cap member attached to the end part of the fixing belt; and an elastic member interposed between the end part of the fixing belt and cap member and unglued to at least one of the fixing belt and cap member.

7. The fixing device according to claim 6, wherein the cap member includes:

a main body part covering outside in the rotation axis direction of the end part of the fixing belt; and a flange part extending from the main body part to inside in the rotation axis direction and covering the external diameter side of the end part of the fixing belt.

8. The fixing device according to claim 7, wherein a rib is arranged in a face at the inside in the rotation axis direction of the main body part.

9. The fixing device according to claim 1 further comprising:

a pressing member pressing the fixing belt to the side of the pressuring rotation body; and a supporting member supporting the pressing member.

10. An image forming apparatus comprising:

a fixing device, wherein the fixing device includes:

a fixing belt rotating around a rotation axis;

a pressuring rotation body coming into pressure contact with the fixing belt to form a fixing nip;

a drive source rotating the fixing belt;

a heat source heating the fixing belt;

detected members held respectively by both end parts of the fixing belt and co-rotated with rotation of the fixing belt;

a pair of rotation detecting parts detecting rotation of the detected members;

a storing part storing standard condition set as a standard for deciding occurrence difficulty of a slip between both end parts of the fixing belt and the detected members; and a controlling part configured to stop heating of the fixing belt by the heat source on a condition that both rotation detecting parts do not detect the rotation of the detected members within a first time when the drive source rotates the fixing belt in a situation where the standard condition is not satisfied, and to stop the heating of the fixing belt by the heat source on a condition that at least one of the rotation detecting parts does not detect the rotation of the detected members within a second time when the drive source rotates the fixing belt in a situation where the standard condition is satisfied, wherein the heat source heats the fixing belt, if one detected member is not rotated and another detected member is rotated, when the drive source rotates the fixing belt in the situation where the standard condition is not satisfied.

11. The image forming apparatus according to claim 10, wherein the storing part stores, as the standard condition, a situation where the temperature of the fixing belt has reached fixing temperature to fix a toner image on a sheet.

12. The image forming apparatus according to claim 10, wherein the storing part stores, as the standard condition, a situation where a sheet is not passed through the fixing nip.

13. The image forming apparatus according to claim 10, wherein a situation after the temperature of the fixing belt reaches fixing temperature to fix a toner image on a sheet before the sheet passes through the fixing nip is set as the situation where the standard condition is satisfied.

14. The image forming apparatus according to claim 10, wherein the detected members are configured to be co-rotated with the rotation of the fixing belt by friction force between both end parts of the fixing belt and the detected members.

15. The image forming apparatus according to claim 10, wherein the detected member includes:

a cap member attached to the end part of the fixing belt; and an elastic member interposed between the end part of the fixing belt and cap member and unglued to at least one of the fixing belt and cap member.

16. The image forming apparatus according to claim 15, wherein the cap member includes:

a main body part covering outside in the rotation axis direction of the end part of the fixing belt; and a flange part extending from the main body part to inside in the rotation axis direction and covering the external diameter side of the end part of the fixing belt.

17. The image forming apparatus according to claim 16, wherein a rib is arranged in a face at the inside in the rotation axis direction of the main body part.

18. The image forming apparatus according to claim 10, wherein the fixing device further includes:

a pressing member pressing the fixing belt to the side of the pressuring rotation body; and a supporting member supporting the pressing member.

* * * * *